United States Patent [19]

Bandukwalla

[11] Patent Number: 4,824,325

[45] Date of Patent: Apr. 25, 1989

[54] DIFFUSER HAVING SPLIT TANDEM LOW SOLIDITY VANES

[75] Inventor: Phiroze Bandukwalla, Olean, N.Y.

[73] Assignee: Dresser-Rand Company, Corning, N.Y.

[21] Appl. No.: 153,592

[22] Filed: Feb. 8, 1988

[51] Int. Cl.[4] ..... F04D 29/44

[52] U.S. Cl. ..... 415/211

[58] Field of Search ..... 415/211, 194, 195, DIG. 1, 415/148, 181

[56] References Cited

U.S. PATENT DOCUMENTS

| | | | |
|---|---|---|---|
| 1,047,663 | 12/1912 | Lawaczeck | 415/211 |
| 2,846,185 | 8/1958 | Widmer | 415/158 |
| 2,996,996 | 8/1961 | Jassniker | 415/157 |
| 3,069,070 | 12/1962 | Macaluso et al. | 415/140 |
| 3,079,127 | 2/1963 | Rowlett et al. | 415/158 |
| 3,369,737 | 2/1968 | Switzer et al. | 415/211 X |
| 3,424,372 | 1/1969 | Blattner | 415/211 X |
| 3,588,270 | 6/1971 | Boelcs | 415/160 |
| 3,781,128 | 12/1973 | Bandukwalla | 415/211 |
| 3,784,318 | 1/1974 | Davis | 415/158 |
| 3,861,826 | 1/1975 | Dean, Jr. | 415/211 |
| 4,008,010 | 2/1977 | Fauconnet | 415/158 X |
| 4,056,330 | 11/1977 | Lieber | 415/155 X |
| 4,070,132 | 1/1978 | Lynch | 415/48 |
| 4,218,182 | 8/1980 | Tsunoda et al. | 415/205 |
| 4,292,807 | 10/1981 | Rannenberg | 415/158 X |
| 4,354,802 | 10/1982 | Nishida et al. | 415/211 X |
| 4,378,194 | 3/1983 | Bandukwalla | 415/49 |
| 4,395,197 | 7/1983 | Yoshinaga et al. | 415/211 |
| 4,403,914 | 9/1983 | Rogo et al. | 415/165 |
| 4,421,457 | 12/1983 | Yoshinaga et al. | 415/211 |
| 4,470,256 | 9/1984 | Palmer | 415/150 X |
| 4,527,949 | 7/1985 | Kirtland | 415/150 |
| 4,544,325 | 10/1985 | Rogo et al. | 415/150 |
| 4,626,168 | 12/1986 | Osborne et al. | 415/211 |

FOREIGN PATENT DOCUMENTS

| | | | |
|---|---|---|---|
| 2135286 | 1/1973 | Fed. Rep. of Germany . | |
| 1160993 | 8/1958 | France | 415/211 |
| 971224 | 1/1971 | France . | |
| 101299 | 6/1958 | Japan . | |
| 119411 | 10/1978 | Japan . | |
| 317623 | 1/1957 | Switzerland | 415/211 |
| 522343 | 8/1974 | U.S.S.R. . | |
| 879047 | 11/1981 | U.S.S.R. | 415/211 |

OTHER PUBLICATIONS

Abdelhamid, A. N., "Analysis of Rotating Stall in Vaneless Diffusers of Centrifugal Compressors," The American Society of Mechanical Engineers, Bulletin No. 80-GT-184, Mar. 1980.

Abdelhamid, A. N., "Effects of Vaneless Diffuser Geometry on Flow Instability in Centrifugal Compression Systems," The American Society of Mechanical Engineers, Bulletin No. 81-GT-10, Mar. 1981.

*Primary Examiner*—Robert E. Garrett

*Assistant Examiner*—Joseph M. Pitko

[57] ABSTRACT

An improved diffuser has a first row of low solidity vanes followed by a second row of low solidity vanes. The chord of the second row of vanes is greater than the chord of the first row. The second row is located radially outward from the trailing edges of the first row and circumferentially displaced to lie in the shadow of the first vane.

4 Claims, 1 Drawing Sheet

DIFFUSER HAVING SPLIT TANDEM LOW SOLIDITY VANES

FIELD OF THE INVENTION

This invention pertains to improvements in compressor diffusers and more particularly to a diffuser for a centrifugal compressor having split tandem, low solidity vanes.

BACKGROUND OF THE INVENTION

High solidity vanes in centrifugal compressor diffusers have high efficiency but poor range. Vaneless diffusers have wide ranges but poor efficiency. Low solidity vanes are known as a useful compromise between high solidity vanes and no vanes. High solidity is defined as a vane chord to pitch ratio greater than one; low solidity as a chord to pitch ratio less than one. Low solidity vane diffusers are somewhat efficient and have nearly as wide a range as vaneless diffusers. It has also been shown that tandem low solidity vanes, acting like split airfoils, result in even higher efficiency than ordinary low solidity vanes, yet have the same range. However, low solidity vanes are generally unable to yield the efficiencies associate with high solidity diffuser vanes, because of the lack of positive guidance in the air flow in the usual low solidity design.

The standard practice in the centrifugal compressor art is to provide an impeller with between 15 and 19 blades. For good efficiency it is desirable to provide 10–50 percent ore diffuser vanes than impeller vanes. This is why many prior art diffusers have between 19 and 22 vanes.

A significant improvement to the art was contributed by Dr. Senoo, who proposed leaving the number of vanes essentially the same, but decreasing the solidity or chord to pitch ratio to less than one. Further, improvements were realized with the tandem vanes, low solidity design disclosed by Senoo et al. in ASME publication 83-GT-3. In doing so, Senoo chose to decrease the number of vanes from about 22 to 11, to maintain low solidity.

OBJECTS AND SUMMARY OF THE INVENTION

Further improvements over Senoo's tandem vane design are realized by returning to the standard practice of providing between 19 and 22 low solidity vanes in a first row and providing a second row of split tandem vanes. This design is characterized as throatless while maintaining a high radius of vaned diffusion and high efficiency obtained with the higher number of vanes. Design flexibility in the throatless diffuser is obtained by splitting or radially displacing the second row of vanes from the first. The vaneless space between the first and second rows gives a wakeless flow region and the design option for circumferential displacement. By decreasing the number of vanes in the second row to half the number in the first row, the low solidity and high range effects are achieved, while still maintaining high efficiency over the widened range.

Thus, is an object of the present invention to provide a diffuser having the combined advantages of low solidity, high solidity and split airfoil diffuser designs.

It is another object of the invention to provide a diffuser design in which there is some design flexibility in both the radial and circumferential location of vanes with respect to one another.

It is yet another object of the invention to provide a diffuser design which can be extended, from two stages or rows of vanes in a circular cascade, to multiple stages in either radial or axial diffusers.

Accordingly, a diffuser for a centrifugal compressor is provided, having a first row of vanes and a second row of vanes. Each vane has a leading and a trailing edge. The leading edges of the second stage are radially outward from the trailing edges of the first stage. There are half as many vanes in the second row as the first and thus the second row vanes are aligned with every other first stage vane. It will be understood that the same design principles allow the present invention to be extended to axial compressors as well.

DESCRIPTION OF THE PREFERRED EMBODIMENT

Figure 1:
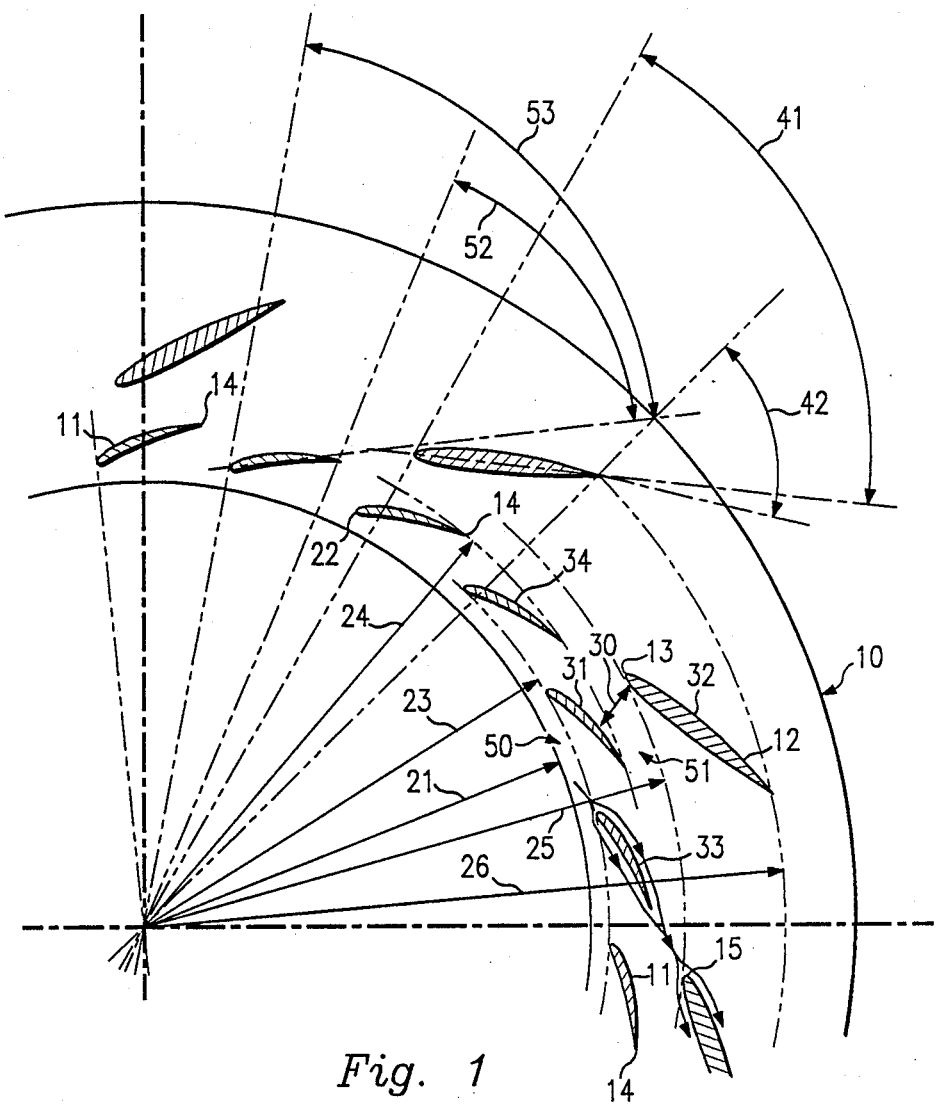
FIG. 1 is a cross section of a diffuser made in accordance with the teachings of the present invention.

A diffuser 10 for a centrifugal compressor is shown in FIG. 1. The diffuser has low solidity vanes 11, which form a first row. The first row has 22 vanes. Larger low solidity vanes 12 form a second row. The second row has 11 vanes. The leading edges 13 of the second row are displaced radially outwardly from the trailing edges 14 of the first row. Note that the second row vanes are in near alignment with the log spiral flow 15 which is associated with a particular first row vane. The vanes from both rows are airfoils. Airfoils are selected from, for example, NACA 65 airfoil designs, depending on factors such as Mach number of the flow and design range. NACA 65 design data is available in NACA Report No. 1368, *Systematic Two Dimensional Cascade Test of NACA* 65 *Series Compressor Blades at Low Speeds.*

A vaneless space 50 is provided between the impeller tip diameter 21 and the leading edge diameter 23 of the first row. The vaneless space 50 is created by making the first row leading edge diameter 6–8% greater than the impeller tip diameter 21. Similarly a vaneless space 51 is provided between the first row trailing edge diameter 24 and the second row leading edge diameter 25. Thus, the second row leading edge diameter is 6–8% greater than the first row trailing edge diameter. In general the leading edges of the first row accept the log spiral flow pattern, but turn the flow toward the radial direction. The incidence of the first row vanes is determined according to standard practice in the diffuser design art. The incidence of the second row vanes is determined by placing the second row in the "shadow" or flow path of the first row. In general the second row vanes are inclined toward the radial direction from the log spiral flow. The multiple row cascade data for NACA 65 can also be used to locate the second or subsequent (third, fourth, etc.) rows of vanes in a particular application.

The resulting diffuser structure is characterized as lacking a hard throat. A partial throat is associated with every other first stage vane. For example, while some throat 30 is found between a first stage vane 31 and an adjacent second stage vane 32. Because fluid flow has alternate paths to the throat regions 30, choke characteristics of the invention are similar to a vaneless or throatless design, but with higher efficiency.

A diffuser has been manufactured in accordance with the above-stated principles. The diffuser has twenty-two first stage vanes and eleven second stage vanes. It has the following dimensions given in inches. The outside diameter 21 of the impeller tip is 10.687. The inside diameter 23 of the first stage is 11.341. The outside diameter 24 of the first stage is 12.269. The inside diameter 25 of the second stage is 13.250. The outside diameter of the second stage is 15.725. The following angular relationships were used. The leading edge stagger angle 41 defined as the angle of a line passing through the leading edge and trailing edges of a second stage vane, with respect to a radius passing through the leading edge of that vane, is 64 degrees, 47 minutes, 41 seconds. The pressure surface exit angle 42 defined as the angle of a line tangent to the upper surface of the vane at the trailing edge, with respect to a radius passing through the trailing edge, is 56 degrees, 52 minutes, 37 seconds. The angular relationships of the first stage vanes are as follows. The trailing edge stagger angle 52 of a first stage vane is 60 degrees, 57 minutes, 18 seconds. The leading edge stagger angle 53 of the first row is 71 degrees. The diffuser so manufactured has been used with a DresserRand 08B-JHH impeller to yield an improvement of 10% improvement in efficiency without sacrificing range with respect to a vaneless diffuser.

This design can be extended to diffusers having three or more stages of fixed vanes by applying the NACA 65 cascade design parameters to third and subsequent rows. Throat prevention in third row vanes is accomplished by aligning third row vanes with every other second row vane. Therefore, the number of vanes in a first row is always an integral multiple of the number of vanes in a third or outermost row. For example, a design including a first row of 20 vanes, a second row of 10 and a third row of 5 vanes is suitable. Maintaining the chord to pitch ratio and the 6–8% vaneless space ratio previously discussed will determine the inner and outer diameter of third and subsequent rows.

The present invention can be applied to axial compressors by incorporating multiple rows of low solidity vanes and flow straightening vanes. Each row has half the number of vanes as the preceding row and is axially spaced from the preceding row, to provide a vaneless space for wake elimination.

While the principles of the diffuser of the present invention have been described above with reference to a particular apparatus, it is to be understood that this description is made by way of example and not as a limitation to the scope of the invention as set forth in the accompanying claims.

What is claimed is:

1. In a compressor diffuser, the improvement comprising:

a first stage of low solidity vanes;

a second stage of low solidity vanes;

each vane having a leading edge and a trailing edge;

the leading edges of the second stage being located radially outward from the trailing edges of the first stage vanes;

the second stage vanes being fewer in number than the first stage vanes; and each second stage vane being in substantial alignment with the flow of fluid passing over a particular first stage vane.

2. The diffuser of claim 1, wherein:

the cord of the second stage vanes is greater than the chord of the first stage vanes.

3. The diffuser of claim 2, wherein:

the stagger angle of the second stage vanes is greater than the stagger angle of the first stage vanes.

4. The diffuser of claim 3, wherein:

the number of vanes in the first stage is double the number of vanes in the second stage.

* * * * *